US005337421A

United States Patent [19]

Jeng

[11] Patent Number: 5,337,421

[45] Date of Patent: Aug. 16, 1994

[54] AIR VENTILATION HELMET

[76] Inventor: Yen-Ming Jeng, 48 Feng-Lian Street, Hsin-Feng Hsian, Hsin-chu Hsien, Taiwan

[21] Appl. No.: 27,379

[22] Filed: Mar. 8, 1993

[51] Int. Cl.[5] ..... A42B 3/00; A42C 5/04

[52] U.S. Cl. ..... 2/425; 2/171.3

[58] Field of Search ..... 2/410, 411, 414, 421, 2/425, 171.3, 424

[56] References Cited

U.S. PATENT DOCUMENTS

| | | | |
|---|---|---|---|
| 3,925,821 | 12/1975 | Lewicki | 2/425 |
| 4,054,953 | 10/1977 | De Barsy | 2/414 |
| 4,081,865 | 4/1978 | Bergee et al. | 2/425 |
| 4,115,874 | 9/1978 | Hasegawa | 2/425 |
| 4,434,514 | 3/1984 | Sundahl et al. | 2/425 |
| 4,627,115 | 12/1986 | Broersma | 2/425 |
| 4,653,123 | 3/1987 | Broersma | 2/425 |
| 4,903,348 | 2/1990 | Broersma | 2/421 |
| 4,903,350 | 2/1990 | Gentes et al. | 2/421 |
| 5,023,958 | 6/1991 | Rotzin | 2/411 |

*Primary Examiner*—Clifford D. Crowder
*Assistant Examiner*—Michael A. Neas
*Attorney, Agent, or Firm*—Andrus, Sceales, Starke & Sawall

[57] ABSTRACT

A cyclist helmet comprises a molded helmet body defining a recessed interior for receiving therein the head of the cyclist and a tail portion through which an air passage is formed with a first opening on the top surface of the helmet and a second opening located on the underside of the tail portion to allow air to flow therethrough and thus creating a negative pressure zone under the tail portion which provides a suction to exhaust the air inside the helmet interior. A fastening strip is provided to secure the helmet on the head of the cyclist.

7 Claims, 4 Drawing Sheets

AIR VENTILATION HELMET

FIELD OF THE INVENTION

The present invention relates generally to a cyclist helmet and in particular to such a helmet which has air ventilation arrangement formed therein to enhance air ventilation thereof.

BACKGROUND OF THE INVENTION

Nowadays, helmets for protection of cyclists and motorcyclist are more and more required to provide a safe transportation of the riders. Motorcyclists are required to wear a helmet when riding in many countries. The development of the motorcyclist helmets is thus very prosperous worldwide.

On the other hand, the cyclist helmet is not so emphasized due to the fact that the cyclists are usually moving in a much lower speed than the motorcyclists. This apparently influences the development of the cyclist helmets. Although the cyclists acknowledge the importance of wearing a helmet in protecting their lives, some cyclists do not like to wear the helmet because the conventional design of the cyclist helmet is an enclosing structure around the head of the cyclists so that air ventilation and thus heat dissipation is very difficult. It may be tolerable in winter time, but definitely in-tolerable in summer due to the sun radiation and the high temperature environment. It is an important issue to develop a helmet which the cyclists are willing to wear in both summer and winter to reduce life losses in traffic accidents.

U.S. Pat. No. 4,903,350 discloses a streamlined helmet which has a plurality of air inlets formed on the top surface of the helmet to allow air to enter the helmet interior so as to achieve the air ventilation and heat dissipation. Such a streamlined helmet, however, has no air conducting means formed inside the helmet interior to help expulsion of the air out of the helmet and this considerably influences the ventilation effect of the helmet.

It is therefore desirable to have an air ventilation helmet which comprises air conducting means therein to help exhaustion of interior air out of the helmet so as to overcome the deficiency of the conventional helmet.

OBJECTS OF THE INVENTION

The principal object of the present invention is to provide a helmet comprising an air passage formed through a tail portion thereof to create a negative zone around the tail portion so as to speed up the exhaustion of air from the helmet interior and thus enhancing the air ventilation and heat dissipation thereof.

It is also an object of the present invention to provide a helmet having at least a passageway connected between the helmet interior and the air passage.

It is another object of the present invention to provide a helmet having air conducting means formed on the inside surface thereof, the air conducting means comprising at least a first air conducting channel extending in a first direction to have an end thereof in fluid connection with the air passage formed through the tail portion.

It is another object of the present invention to provide a helmet wherein the air conducting means further comprises at least a second air conducting channel extending in a second direction not parallel with the first direction to have an end thereof in fluid connection with the first air conducting channel.

It is another object of the present invention to provide a helmet having at least an inlet formed on a front edge opposite to said tail portion wherein the inlet is in fluid connection with the first air conducting channel.

It is another object of the present invention to provide a helmet comprising at least a longitudinal slot formed on the top surface thereof and extending from the front edge thereof toward said tail portion with the first opening of the air passage located therein.

It is a further object of the present invention to provide a helmet comprising cushion pads disposed on the inside surface thereof to provide a cushioning effect between the helmet and the head of a cyclist.

To achieve the above and other objects, there is provided a helmet comprising a molded helmet body defining a recessed interior for receiving therein the head of the cyclist and a tail portion through which an air passage is formed with a first opening on the top surface of the helmet and a second opening located on the underside of the tail portion to allow air to flow therethrough and thus creating a negative pressure zone under the tail portion which provides a suction to exhaust the air inside the helmet interior. A fastening strip is provided to secure the helmet on the head of the cyclist.

Other objects and advantages of the invention will be apparent from the following description of a preferred embodiment taken in connection with the accompanying drawings wherein:

DETAILED DESCRIPTION OF THE PREFERRED EMBODIMENT

Figure 1:
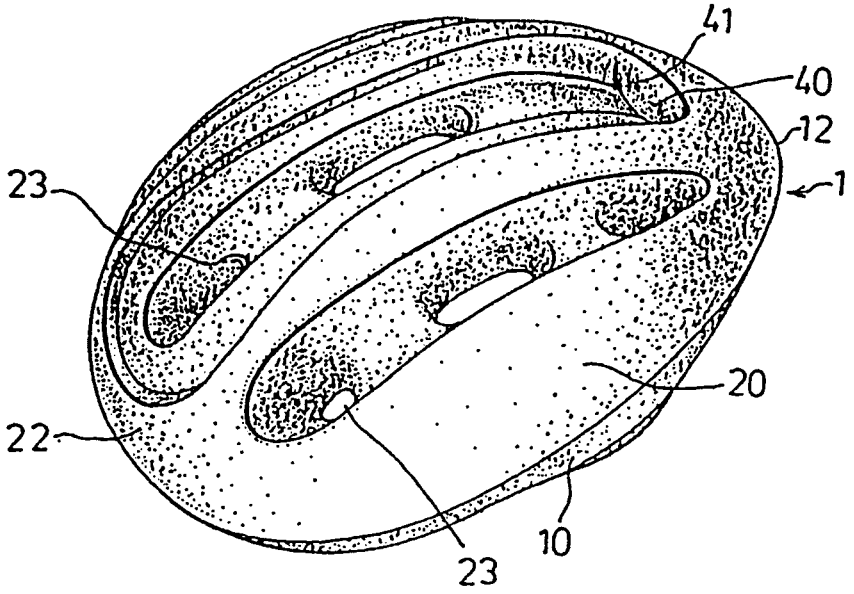
FIG. 1 is a perspective view showing a helmet constructed in accordance with the present invention.
Figure 2:
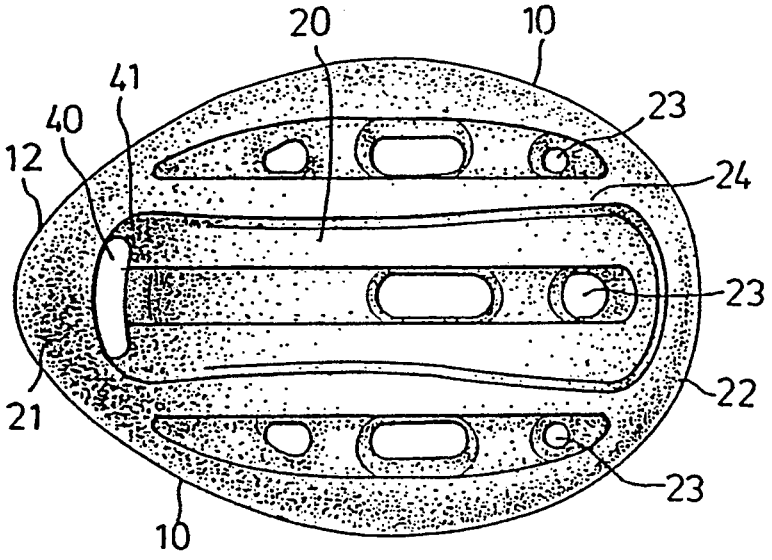
FIG. 2 is a top plan view of the helmet shown in FIG. 1.

With reference to the drawings and in particular to FIGS. 1, 2, 3 and 4, wherein a helmet constructed in accordance with the present invention, generally designated with reference numeral 1, is shown, the helmet 1 comprises a molded helmet body 10 having a top surface 20 and a recessed interior 30 defining therein a space 31 for fitting over the head H of a cyclist. The helmet 1 comprises a tail portion 11 through which an air passage 40 is formed with a first opening 41 thereof located on a rear portion 21 of the top surface 20 and a second opening 42 thereof located on the underside 12 of the tail portion 11 so that when air flows over the helmet 1, an air flow will be conducted to pass through the air passage 40 and create a negative pressure zone under the underside 12 of the tail 11 due to the flowing speed thereof to provide a suction to the air within the recessed interior 30 of the helmet 1 and thus helping ventilation thereof.

Figure 4:
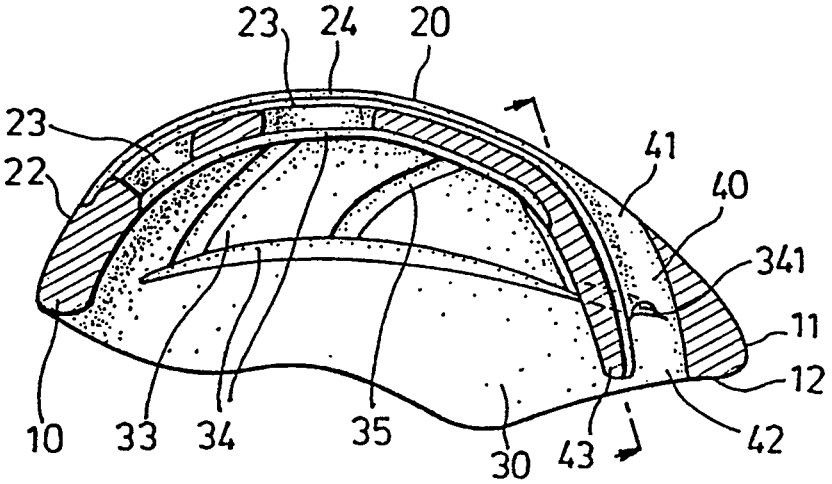
FIG. 4 is a longitudinal sectional view of the helmet shown in FIG. 1.

It can be observed from FIG. 4 that since the first opening 41 of the air passage 40 is located on the top surface 20 of the helmet 1, air can be readily conducted into and through the air passage 40 so as to form an air flow at the tail portion of the helmet 1 which lowers down the local static pressure of this zone, as compared to the interior pressure of the helmet interior 30. This moves the air within the interior 30 to flow toward the negative pressure zone and thus providing air ventilation of the helmet interior 30.

To provide a better ventilation of the helmet 30, air conducting means 33 is provided on the inside surface 32 of the helmet interior 30. The air conducting means 33 comprises at least a first air conducting channel 34 extending along a first direction across a substantial portion of the inside surface 32. The first air conducting channel 34 has an end 341 in communication with the air passage 40 to allow the air inside the helmet interior 30 to be drained to the air passage 40 and thus exhausted out thereof by the suction force of the negative pressure zone around the tail 11. The arrangement of the air conducting means 33 and the relationship thereof with respect to the air passage 40 can be readily seen in the bottom side view shown in FIG. 3.

Figure 3:
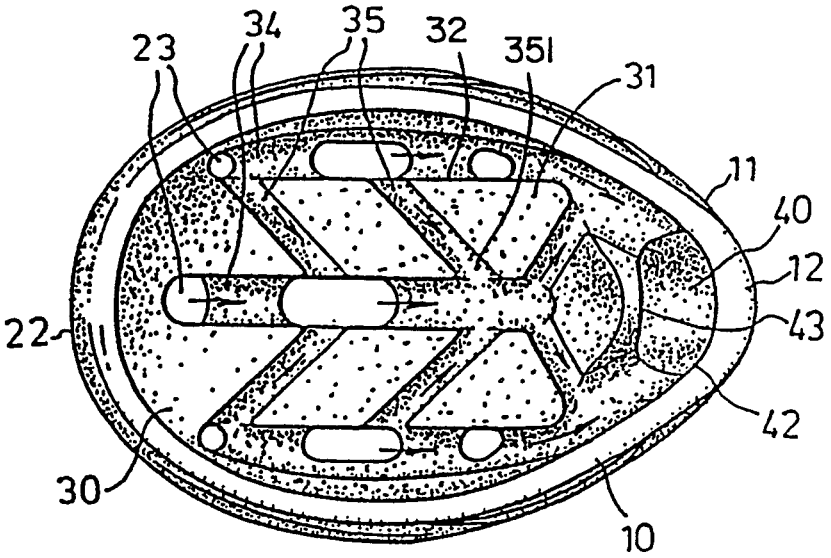
FIG. 3 is a bottom view of the helmet shown in FIG. 1.

Preferably, there are three first air conducting channels 34 extending in a parallel fashion, as that shown in FIG. 3.

In addition to the first conducting channels 34, the air conducting means 33 further comprises at least a second air conducting channel 35 which extends along a second direction oblique with respect to the first direction and has at least an end 351 opened on the first conducting channel 34. This further helps ventilation of air inside the helmet interior 30.

To this point, it is understood that with such an arrangement of the air conducting means 33, the air ventilation and heat removal from the helmet interior 30 is considerably improved over the conventional design of helmets. Nevertheless, in order to further improve the air ventilation and heat dissipation, there are provided a plurality of air inlet openings 23 on the front side 22 of the helmet top surface 20. The air inlets 23 are respectively in fluid communication with the first air conducting channels 34 so that the air entering the inlets 23 expels the air originally inside the helmet interior 30 and already-heated by the heat generated from the head H of the cyclist toward the tail side 11 of the helmet 1. This speeds up the ventilation and exhaustion of the air inside the helmet interior 30.

There may be provided with more than one air inlet 23 corresponding to any one of the first air conducting channels 34. It can be understood that the closer to the front edge of the helmet 1 the air inlet 23 is located, the more air it allows to enter the helmet interior 30 but less heat it can remove. The more remote to the front edge of the helmet 1 the air inlet 23 is, the more heat it can dissipates but less air can be sucked in. Nevertheless, no matter where such air inlets are located, they provide a better air ventilation and heat dissipation effect.

In accordance with the instant invention, there is provided on the helmet top surface 20 a longitudinal slot 24 extending from the front edge of the helmet 1 to the tail side thereof. The first opening 41 of the air passage 40 is preferably formed within the longitudinal slot 24.

There may be also provided a plurality of cushion pads or the likes on the inside surface 32 of the helmet interior 30 to form a comfort compliance of the helmet 1 with the head H of the cyclist.

Figure 5:
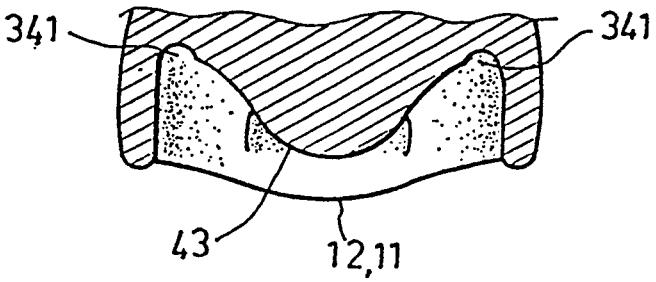
FIG. 5 is a cross-sectional view taken along the direction of the arrows indicated in FIG. 4.

FIGS. 4 and 5 respectively illustrate different sectional views of the helmet 1 constructed in accordance with the present invention. The improved features of the present invention can thus be more easily observed from these figures. The location of the air passage 40 with respect to the helmet 1 is clearly shown and thus it can be found that the speed of the air flowing through the air passage 40 is much higher than that within the helmet interior 30 so that the static pressure of the air flowing through the air passage 40 is lower than that inside the helmet interior 30 which improves air exhaustion from the helmet interior 30.

In the cross-sectional view shown in FIG. 5, the connection of the air passage 40 with the helmet interior 30 is shown. The air passage 40 with the end 341 of the first air conducting channel 34 in communication therewith has at the second end 42 thereof a tongue structure 43 which allows air to pass therethrough from the two sides thereof. With such a tongue structure, the air flow coming along the side edges of the helmet 1 and that exiting the air passage 40 come into mixing with each other under the tail 11 of the helmet 1 to create the negative pressure zone which speeds up the exhaustion of air from the helmet interior 30 and thus achieving the purposes of air ventilation and heat dissipation.

Figure 6:
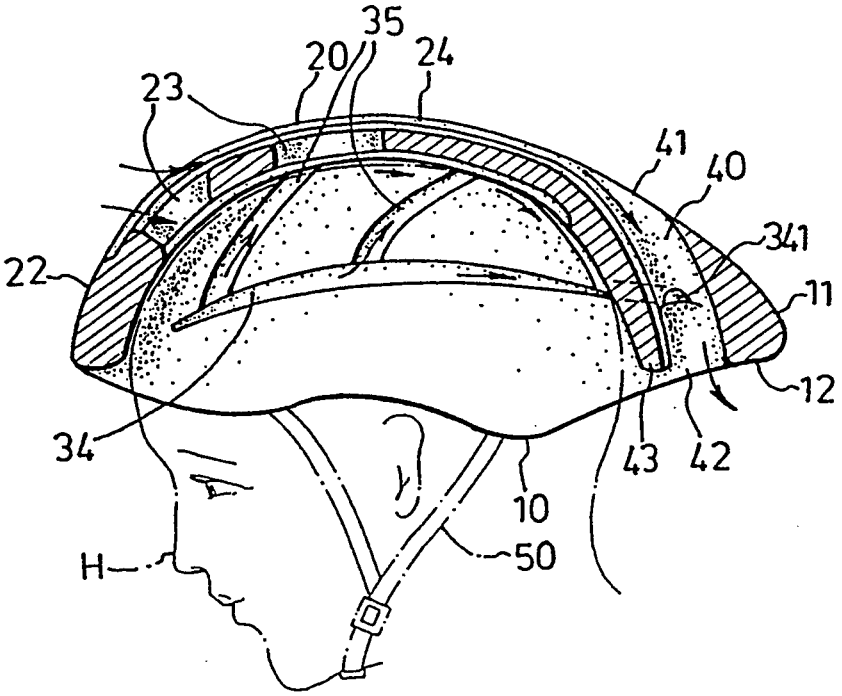
FIG. 6 is a perspective view showing the helmet of the present invention worn on the head of a cyclist.

FIG. 6 shows how a cyclist wears the helmet 1 of the present invention and it can be seen that the present invention provides a comfortable and safe helmet with a better air ventilation and heat dissipation. As shown in FIG. 6, the helmet 1 comprises a fastening strip-like element 50 which is mounted on the helmet 1 in order to secure the helmet 1 on the head H of the cyclist.

It is apparent that although the invention has been described in connection with a preferred embodiment, those skilled in the art may make changes to certain features of the preferred embodiment without departing from the spirit and scope of the invention as defined in the appended claims.

What is claimed is:

1. A helmet comprising:

a helmet body defining a recessed interior for receiving therein the head of a cyclist and having a front edge, a tail portion opposite said front edge, and a top surface between said front edge and said tail portion, said tail portion having an underside formed rearmost from said front edge and formed therein with an elongated air passage extending therethrough rearwardly and downwardly from said top surface away from said front edge, said air passage having a first opening formed on said top surface of said helmet body and a second opening formed on said underside of said tail portion; said air passage allowing an air flow through said helmet body and said recessed interior and creating a negative pressure zone under said tail portion which provides a suction to exhaust air inside said recessed interior, and fastening means mounted on said helmet body for securing said helmet on the head of the cyclist.

2. A helmet as claimed in claim 1 wherein said helmet body comprises at least a passageway connected between said recessed interior and said air passage.

3. A helmet as claimed in claim 1 wherein said recessed interior has an inside surface on which air conducting means is formed, said air conducting means comprising at least a first air conducting channel formed on said inside surface and extending in a first direction to have an end thereof in fluid connection with said air passage formed through said tail portion.

4. A helmet as claimed in claim 3 wherein said air conducting means further comprising at least a second air conducting channel formed on said inside surface and extending in a second direction not parallel with said first direction to have an end thereof in fluid connection with said first air conducting channel.

5. A helmet as claimed in claim 3 wherein said front edge has at least one inlet formed thereon, said inlet being in fluid connection with said first air conducting channel.

6. A helmet as claimed in claim 1 wherein said helmet comprises at least a longitudinal slot formed on the top surface thereof and extending from a front edge thereof toward said tail portion, the first opening of said air passage being located within said slot.

7. A helmet as claimed in claim 1 wherein said helmet comprising cushion pads disposed on said inside surface to provide a cushioning effect between said helmet and the head of the cyclist.

* * * * *